US009635924B1

(12) United States Patent
Herrera

(10) Patent No.: US 9,635,924 B1
(45) Date of Patent: May 2, 2017

(54) CAT EYE MAKEUP APPLICATOR

(71) Applicant: Rachel Lorraine Herrera, Los Angeles, CA (US)

(72) Inventor: Rachel Lorraine Herrera, Los Angeles, CA (US)

( * ) Notice: Subject to any disclaimer, the term of this patent is extended or adjusted under 35 U.S.C. 154(b) by 5 days.

(21) Appl. No.: 14/532,932

(22) Filed: Nov. 4, 2014

Related U.S. Application Data

(60) Provisional application No. 61/899,757, filed on Nov. 4, 2013.

(51) Int. Cl.
*A45D 34/04* (2006.01)
*A45D 40/26* (2006.01)
*A45D 40/30* (2006.01)

(52) U.S. Cl.
CPC ..... *A45D 34/04* (2013.01); *A45D 40/26* (2013.01); *A45D 40/30* (2013.01); *A45D 2200/1009* (2013.01); *A45D 2200/1072* (2013.01)

(58) Field of Classification Search
CPC .... A45D 2200/1009; A45D 2200/1018; A45D 2200/1072; A45D 40/26; A45D 34/04; A45D 29/17; A45D 29/12
USPC ..... 132/320
See application file for complete search history.

(56) References Cited

U.S. PATENT DOCUMENTS

| | | | | |
|---|---|---|---|---|
| 3,343,552 | A * | 9/1967 | Steffen | A45D 40/26 132/320 |
| 6,508,255 | B1 * | 1/2003 | Glover | A45D 40/26 132/216 |
| 7,334,586 | B2 | 2/2008 | Pilmanis | |
| 7,478,958 | B2 | 1/2009 | Ramet | |
| 7,841,793 | B2 | 11/2010 | Ramet | |
| 8,893,731 | B2 * | 11/2014 | Pires | A45D 33/006 132/294 |
| 2006/0107967 | A1 * | 5/2006 | Kawai | A45D 34/041 132/320 |
| 2015/0083158 | A1 * | 3/2015 | Abraham | A45D 40/24 132/317 |
| 2015/0366763 | A1 * | 12/2015 | Barilari | A61K 8/0204 132/320 |
| 2016/0081456 | A1 * | 3/2016 | Grund | A45D 40/262 132/200 |

FOREIGN PATENT DOCUMENTS

| | | | | |
|---|---|---|---|---|
| GB | 2503461 | * | 1/2014 | A45D 34/04 |

* cited by examiner

*Primary Examiner* — Tatiana Nobrega
(74) *Attorney, Agent, or Firm* — Myers Andras LLP; Joseph C. Andras

(57) ABSTRACT

A cat eye makeup applicator with a handle and a cat eye stamping member having a base portion for detachable connection to the handle and having left-side and right-side, mirror image stamping surfaces for transferring eyeliner to a user's skin and creating perfect, symmetrical cat eyes.

11 Claims, 14 Drawing Sheets

CAT EYE MAKEUP APPLICATOR

CROSS REFERENCE TO RELATED APPLICATIONS

This application claims the benefit of U.S. Provisional Patent Application Ser. No. 61/899,757, filed Nov. 4, 2013.

BACKGROUND OF THE INVENTION

Field of the Invention

This patent application relates generally to cosmetic tools and, more particularly, a cat eye makeup applicator that comprises a handle and a cat eye stamping member.

Description of the Related Art

Eyeliner is a cosmetic, or form of makeup, that is commonly used by women to visually define their eyes. It draws attention to the eyes, and can even enhance or change the apparent shape of the eyes. Eyeliner is provided in various forms (e.g. liquid, paste, or gel) and in various colors (e.g. black, brown, gray, bright colors, etc.). Eyeliner is applied fully or partially above, below, or around the eyes as desired, and in various thicknesses, as desired, to achieve the desired effect.

Eyeliner is usually applied by hand using an applicator in the form of a pen, a pencil, or a brush. A pencil having a soft core of eyeliner is commonly used to form a less intense application that, if desired, may be smudged with the user's fingers. A pen is usually used to apply a thinner, darker line. A brush is used to apply eyeliner after dipping the brush in a bottle of liquid eyeliner or swabbing the brush against a container of gelatinized eyeliner.

When applied above the eyes, eyeliner is applied to the inside and/or outside of the user's upper eyelids near the upper lash. When applied below the eyes, eyeliner is applied to the inside and/or outside of the user's lower eye lids, near the lower lash. When applied around the eyes it usually but not always extends from the inside corner to the outside corner, both above and below the eyes. On occasion, the eyeliner is extended beyond the outside corner of the eyes to form what is sometimes called a "wing" or, more commonly, a "cat eye."

A typical cat eye has a thicker base portion with a tapering extension, or wing, that extends outward at a desired angle and in straight or curved fashion. The overall cat eye can be large, small, curved, natural, or dramatic, to name but a few possible descriptions.

The cat eye style of eye makeup is best described as an extension of the eyeliner on the top of the eye drawn out past the outer corner of the eye to a pointed shape. There is an infinite combination of shape, length, width and angle, all of which are personal preference for the individual. Cat eye makeup has been in fashion throughout the ages, one of the most recognizable and famous examples being Cleopatra. Cat eye makeup can be seen on Hollywood legends like Elizabeth Taylor, Marilyn Monroe, Sophia Loren and Raquel Welch, as well as contemporary singers such as Lady Gaga, Madonna, and Katy Perry.

If the user wants the eyeliner to include cat eyes, they are traditionally applied in a freehand manner as with the rest of the eyeliner. When doing it by hand, it is difficult to keep both cat eyes identical and get the desired shape. It takes a great deal of skill because the left and right cat eyes must be symmetrical, and because there is a certain point that you need to start applying each cat eye and another point that, as you move, you need to "wing" it while distancing the applicator from the user's face to narrow the stroke. It is especially challenging for somebody that is applying eyeliner around their own eyes.

Making one perfect cat eye, much less two identical and perfectly formed cat eyes, can be challenging for a professional and is even more intimidating and daunting for the average person who is not trained in makeup techniques. It can be challenging to make symmetrical cat eyes because the length of the cat eye tail must be the same on both eyes, the angle of the cat eye must be the same on both eyes, and the varying width of the cat eye must be the same at all points on both eyes. The inventor has many clients that do not even attempt to do their own cat eyes.

There remains a need, therefore, for a cat eye makeup applicator that resolves these difficulties and makes cat eyes accessible for everyone, i.e. for a cat eye makeup applicator that simplifies the application cat eye makeup and makes it uniform and easy for everyone to master.

DESCRIPTION OF THE DRAWINGS

The invention can be best understood in connection with a detailed description of the preferred embodiments and the following figures.

DETAILED DESCRIPTION OF THE PREFERRED EMBODIMENTS

The present invention relates to a cat eye makeup applicator, a new tool for easily and repeatedly making perfect, symmetrical cat eyes, every time, making cat eye eyeliner accessible for everyone.

A cat eye makeup applicator according to this invention is ideal for professional makeup artists because it is fast and efficient. Although the inventor has been a professional celebrity makeup artist for over ten years, she still finds it challenging to perfectly draw cat eyes with symmetry. Time and time again, in movies, television, and even on the red carpet, she has seen the clients of others makeup artists with dramatically different cat eyes on each eye. It can be awkward and embarrassing for the client. The cat eye applicator is also perfect for continuity in films and television because it is always the same. It takes out the error aspect of using conventional freehand techniques to draw cat eyes by stamping it on for you. The cat eye makeup applicator is great for photo shoots and fashion shows because it is fast and efficient to quickly and easily stamp on the cat eyes for all of the models.

A cat eye applicator according to this invention is also perfect for any individual who wants the cat eye look. It makes it easy for the consumer to stamp the cat eye shape onto their own eye—making it perfect each and every time. The various shapes available for the stamping member of the cat eye applicator gives the consumer a variety of different looks to choose from, classic and sophisticated or outrageous and crazy fun. Makeup should be fun. It allows for the person wearing it to have their own certain look that they always want to maintain and it allows them to express their individuality and playfulness through makeup. A cat eye applicator is the perfect way to let the user individualize their makeup, or make a statement, or stand out.

A cat eye makeup applicator according to this invention can take on a number of different forms, and several exemplary embodiments are described herein.

Figure 1A:
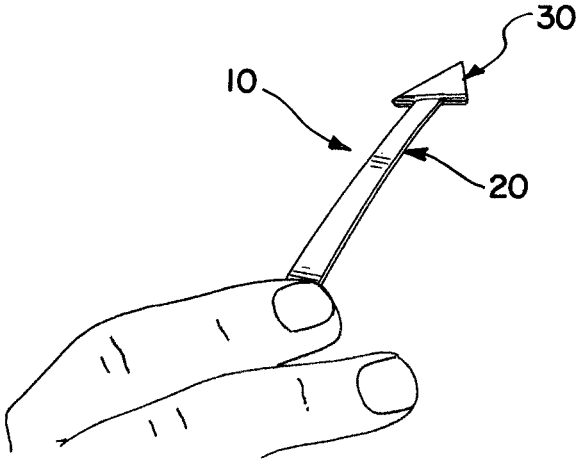
FIG. 1*a* show a user holding a cat eye makeup applicator 10 comprised of a handle 20 and a cat eye stamping member 30 according to a first preferred embodiment of the invention.

FIG. 1*a* shows a user holding a first preferred cat eye makeup applicator 10. As shown in the figures and described below, the illustrated cat eye makeup applicator 10 broadly comprises a handle 20 and a cat eye stamping member 30.

Figure 1B:
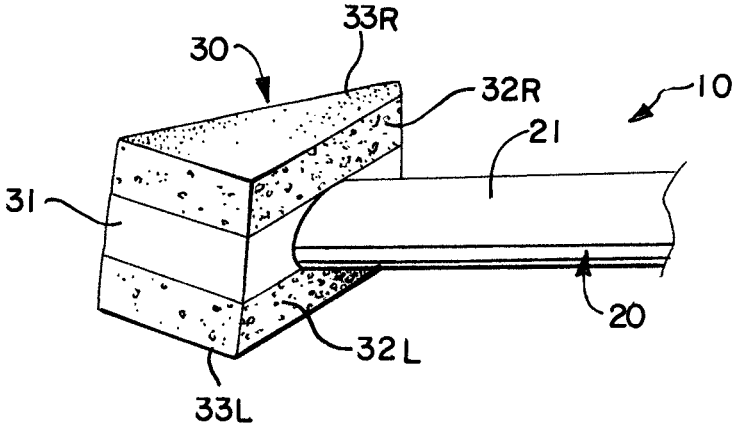
FIG. 1*b* is a close-up view of the cat eye makeup applicator 10 of FIG. 1, showing a distal end 21 of the handle 20 and its cat eye stamping member 30 having a left-side cat eye stamp 33L and a right-side cat eye stamp 33R.

As best shown in the close-up view of FIG. 1*b*, the cat eye applicator 10 comprises a handle 20 with a distal end 21, and a cat eye stamping member 30 located at the distal end. The preferred handle 20 is made of durable plastic, but any suitable material(s) may be used alone or in combination with one another. The preferred cat eye stamping member 30 is comprised of a base portion 31 and at least one stamping surface (e.g. 33L or 33R) having a desired shape. The base portion 31, here a rigid substrate, provides a left-side stamp support and a right-side stamp support. Focusing on the right-side, the preferred cat eye makeup applicator 10 has a cat eye stamping member 30 that comprises a base portion 31 with a right-side stamp support, and a right-side stamping surface 33R supported by a foam core 32R. In this first embodiment, the right-side stamping surface is a rubber surface that is supported by the foam core.

As shown, however, the cat eye stamping member 30 has a left side and a right side stamping surface 33L, 33R that are mirror images of one another, making overall applicator easily reversible so that it can be used for the left eye and then simply turned over and used for the right eye. And, in more detail, the base portion 31, here a rigid substrate, is sandwiched between left and right foam cores 32L, 32R that, in turn, support left and right-side stamping surfaces 33L, 33R, here rubber surfaces.

The stamp surfaces 33L, 33R can be easily cleaned before each use with a gentle cleanser, soap and water or alcohol wipes. The cat eye makeup applicator 10 is easy to use and gives everyone the ability to create the perfect cat eye look, anytime and anywhere.

A presently preferred method of using the first preferred cat eye makeup applicator 10 is as follows:

Right Eye

Figure 2:
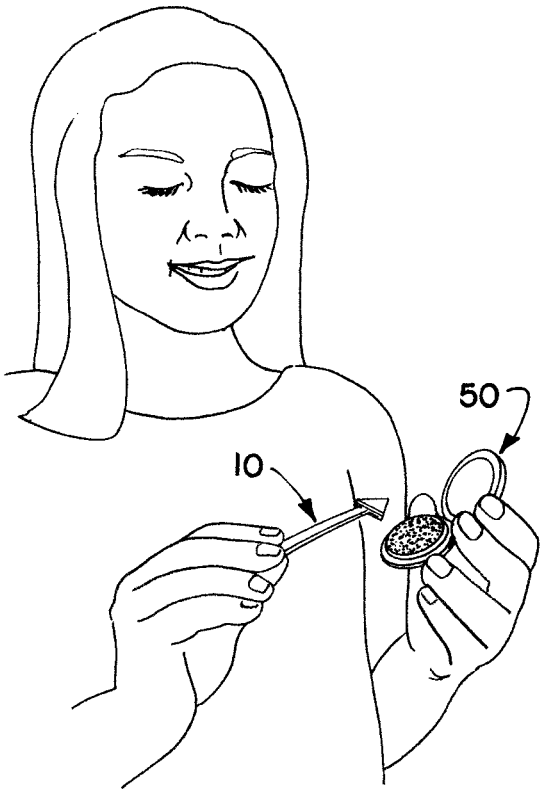
FIGS. 2 to 3 show the user dipping the right-side cat eye stamp 33R of the cat eye stamping member 30 into a liquid eyeliner inkpad 50.
Figure 3:
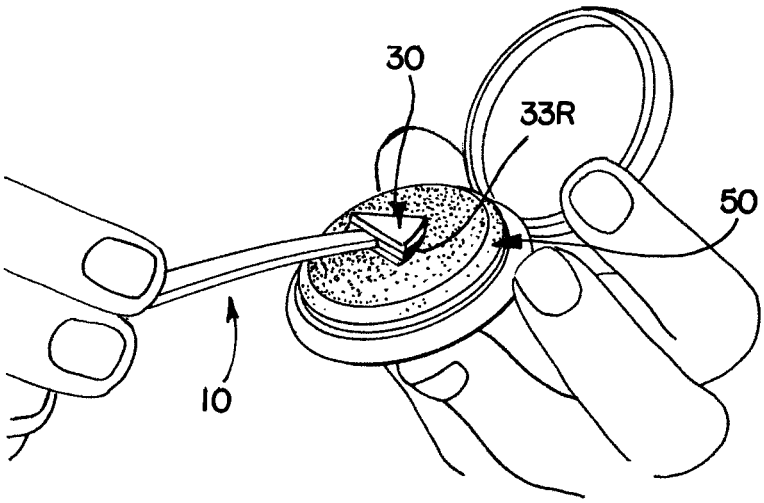
Figure 4:
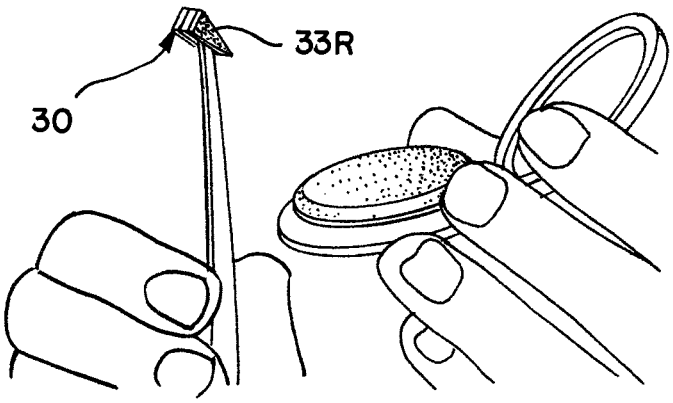
FIG. 4 shows the liquid eyeliner on the rubber stamp part of the right-side cat eye stamp 33R of the cat eye stamping member 30.

FIGS. 2 to 3 show the user dipping the right-side stamping surface 33R of the cat eye makeup applicator 10 into an inkpad 50 of liquid eyeliner in preparation for applying the stamping surface 33R to the outside corner of her right eye. FIG. 4 shows the liquid eyeliner on the rubber surface of the right-side stamping surface 33R of the cat eye makeup applicator 10, ready for application.

Figure 5:
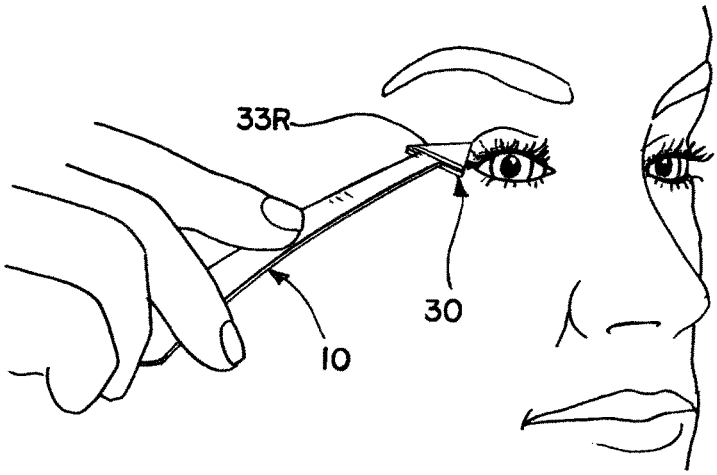
FIG. 5 shows the user placing the right-side cat eye stamp 33R onto the outside corner of her right eye, liquid liner face down touching the skin, pressing slightly.

FIG. 5 shows the user placing the stamping surface 33R onto the outside corner of her right eye, liquid liner face down touching the skin, pressing slightly.

Figure 6:
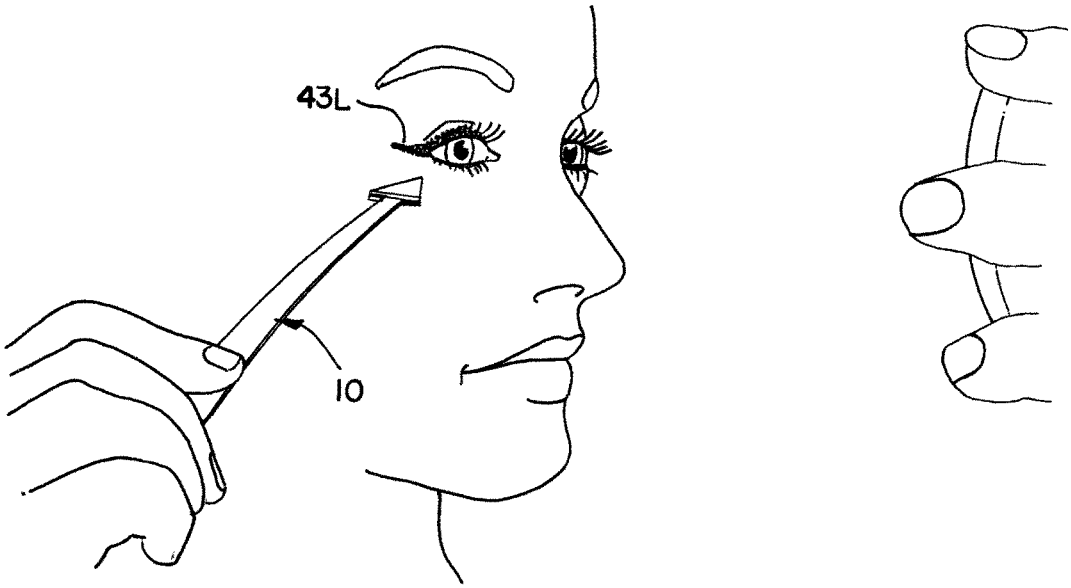
FIG. 6 shows the user moving the cat eye applicator 10 away from her face to reveal a perfect right-side cat eye shape 43R.

FIG. 6 shows the user moving the cat eye applicator 10 away from her face to reveal the outline of the right-side cat eye shape 43R.

Figure 7:
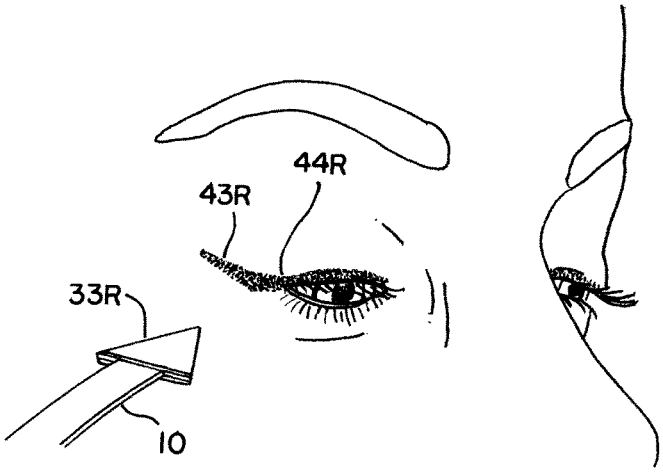
FIG. 7 is a close-up view of the outline of the cat eye shape 43R left by the cat eye applicator 10 on the right eye, the cat eye shape 43R having an inside edge 44R.

FIG. 7 is a close-up view of the outline of the cat eye shape 43R left by the cat eye applicator 10 on the right eye. As shown, the resulting cat eye shape 43R has an inner edge 44R that must be extended with additional eyeliner.

Figure 8:
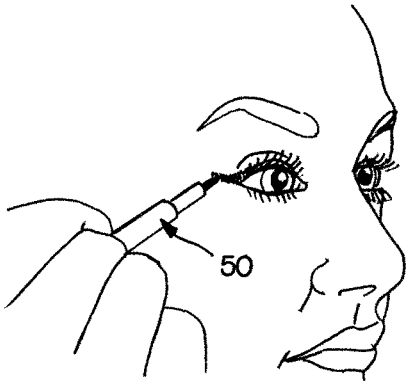
FIGS. 8 to 9 show the user using a liquid eyeliner pen 50 to draw eyeliner 53R from the stamped cat eye shape 43R, across the eye, to complete the look on the right eye.
Figure 9:
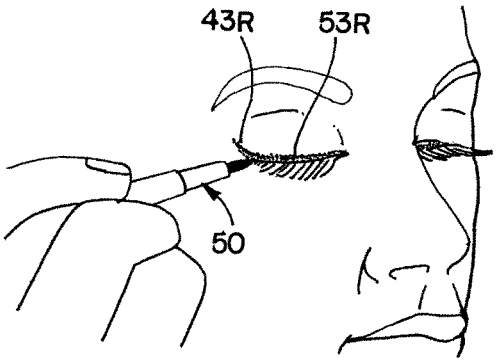

FIGS. 8 to 9 show the user using a liquid eyeliner pen 50 to draw a segment 53R of additional eyeliner from the stamped shape 43R, across the eye, to complete the look on the right eye.

Figure 10:
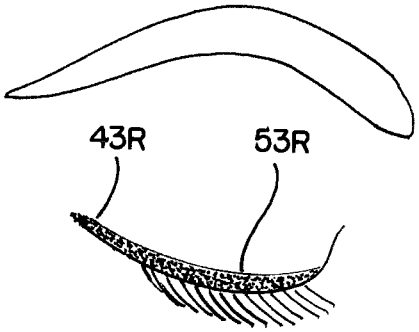
FIG. 10 shows the finished look of the user's right eye closed.

FIG. 10 shows the finished look of the user's right eye closed, with the stamped cat eye shape 43R blended into the segment 53R.

Figure 11:
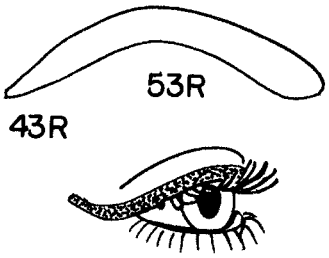
FIG. 11 shows the finished look of the user's right eye open, side view.

FIG. 11 shows the finished look of the user's right eye open, side view.

Figure 12:
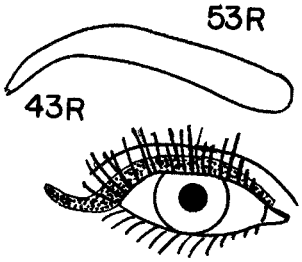
FIG. 12 show the finished look of the user's right eye open, front view.

FIG. 12 show the finished look of the user's right eye open, front view.

Left Eye

Figure 13:
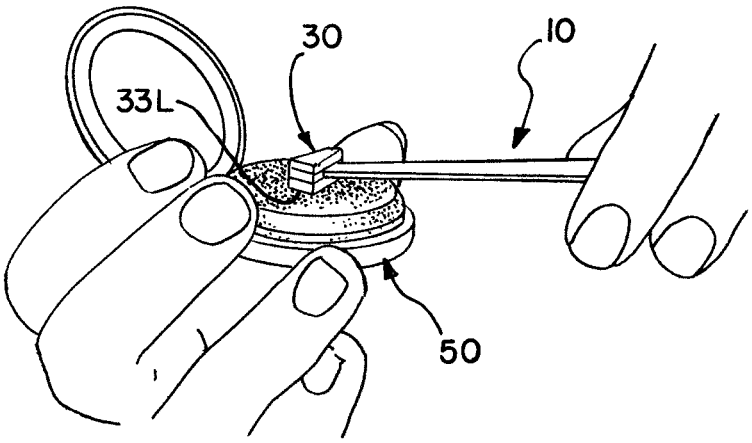
FIG. 13 shows the user dipping the left-side cat eye stamp 33L located on the other side of the cat eye stamping member 30 of the cat eye applicator 10 into the liquid eyeliner inkpad 50.

The process is now repeated for the user's left eye. FIG. 13 shows the user dipping the left-side stamping surface 33L of the cat eye applicator 10 into the liquid eyeliner ink pad 50.

Figure 14:
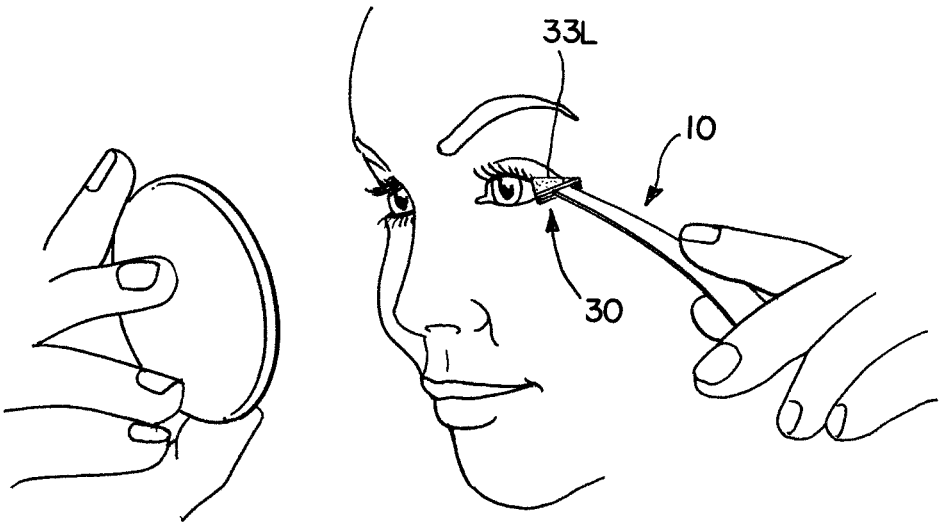
FIG. 14 shows the user placing the left-side cat eye stamp 33L onto the outer corner of her left eye and pressing slightly.

FIG. 14 shows the user placing the left-side stamping surface 33L onto the outer corner of her left eye and pressing slightly.

Figure 15:
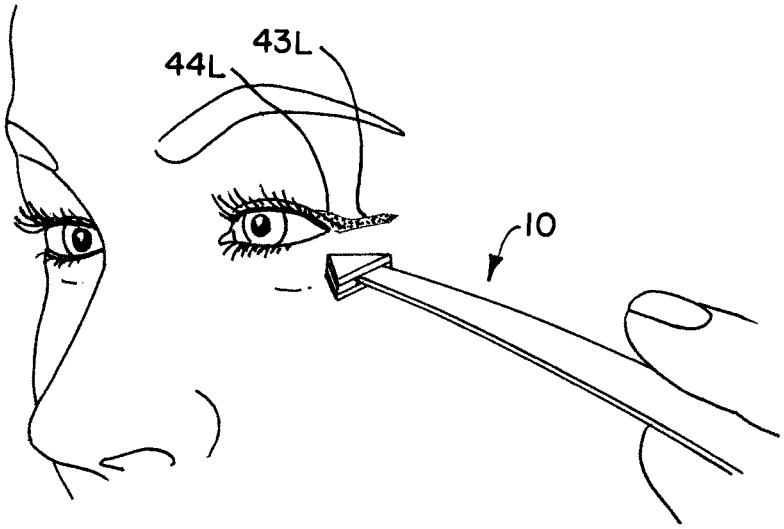
FIG. 15 shows eyeliner now in place on the outside corner of her left eye in the form of a perfect left-side cat eye shape 43L having an inner edge 44L.

FIG. 15 shows the left-side cat eye shape 43L now in place on the outside corner of her left eye. The resulting cat eye shape 43L has an inner edge 44L that, as before, must be extended with additional eyeliner.

Figure 16:
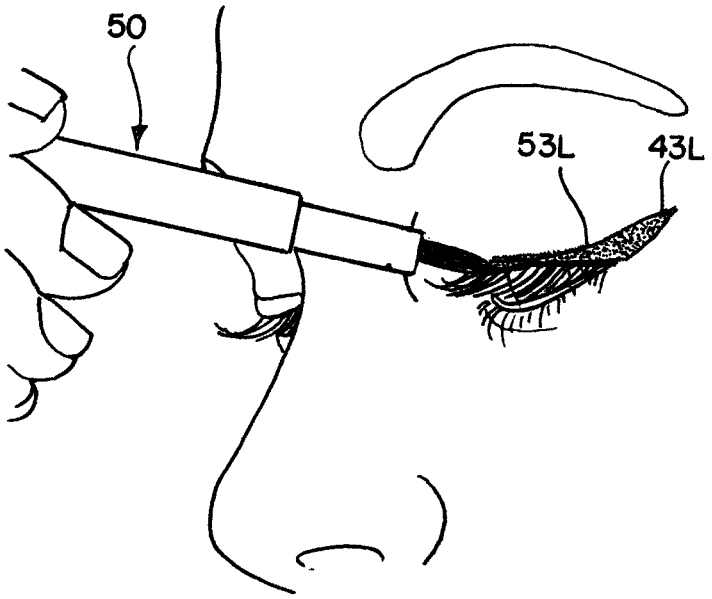
FIG. 16 shows the user using a liquid eyeliner pen 50 to draw eyeliner 53L from the edge 44L of the stamped cat eye shape 43L at the outside corner of her left eye, across her eyelid, to the inside corner of her eye.

FIG. 16 shows the user using a liquid eyeliner pen 50 to draw a segment 53L from the left-side cat eye shape 43L at the outside corner of her left eye, across her eyelid, to the inside corner of her eye.

Finished

Figure 17:
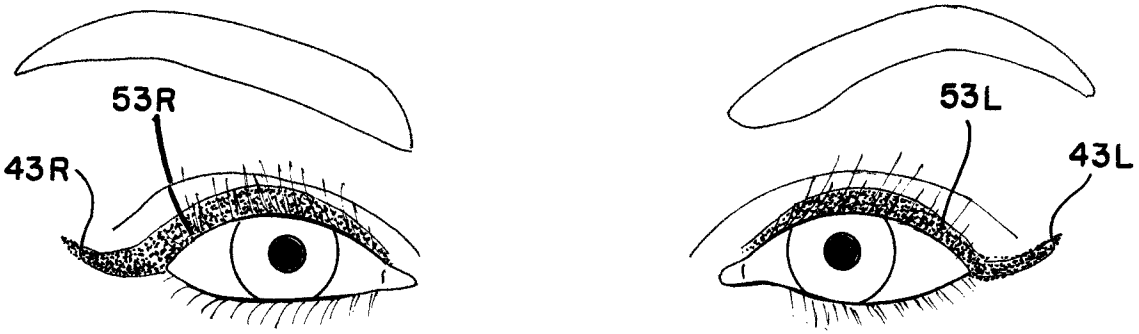
FIG. 17 shows both eyes after using the cat eye makeup applicator 10 to apply the left-side and right-side cat eye shapes 43L, 43R, and after application of additional eyeliner 53L, 53R using an eyeliner pen 50.
Figure 18:
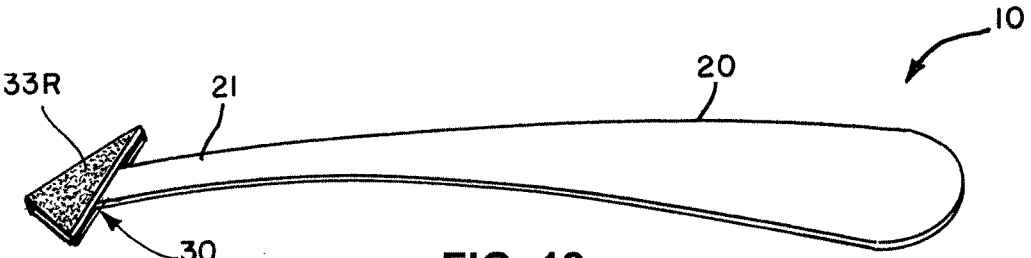
FIGS. 18 to 21 show a first preferred prototype embodiment of the cat eye makeup applicator 10.
Figure 19:
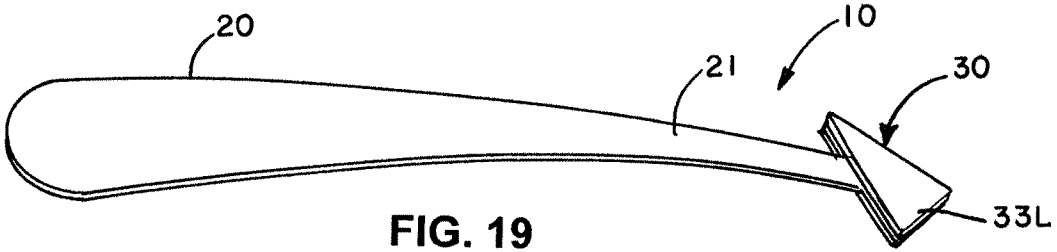
Figure 20:
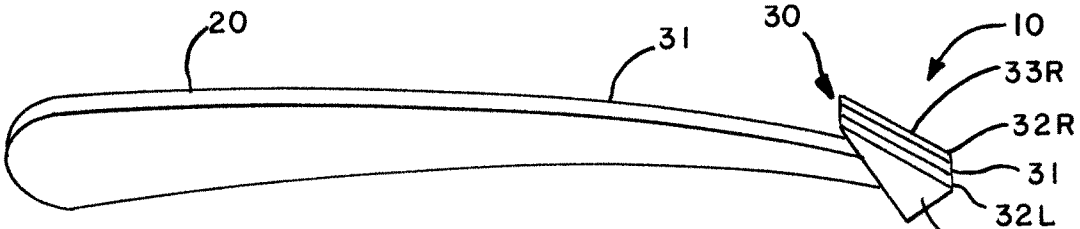
Figure 21:
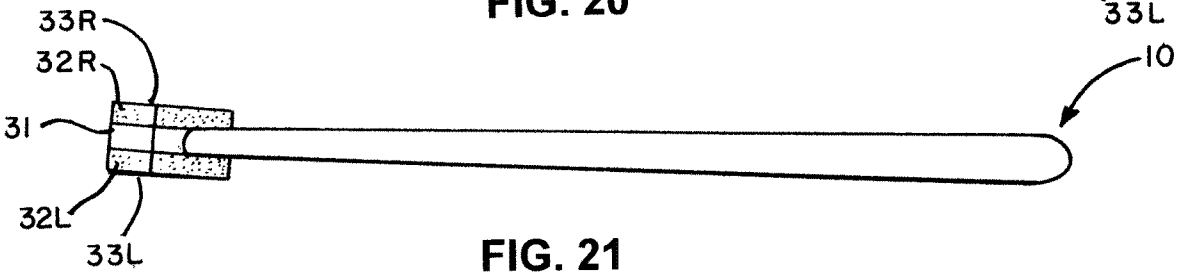

FIG. 17 shows both eyes after using the cat eye applicator 10, with the perfect, symmetrical cat eye shapes 43L, 43R blended into the segments 53L, 53R.

First Preferred Embodiment

FIGS. 18 to 21, best viewed in conjunction with FIG. 1*b*, show a first preferred prototype embodiment of the cat eye makeup applicator 10 from various sides. As shown, the cat eye makeup applicator 10 comprises a handle 20 having a distal end 21, and a cat eye stamping member 30 attached to the distal end 21 of the handle 20. The cat eye stamping member 30 comprises a left-side cat eye stamp or stamping surface 33L and a right-side cat-eye stamp or stamping surface 33R on an opposite side. The two stamping surface 33L, 33R are mirror images of one another so that the cat eye makeup applicator 10 can be reversed for applying left and right-side cat eyes and so that when one cat eye stamping surface is being applied to the user's eyes, the opposite side stamping surface functions as a placement guide.

Other Stamp Shapes

Figure 22:
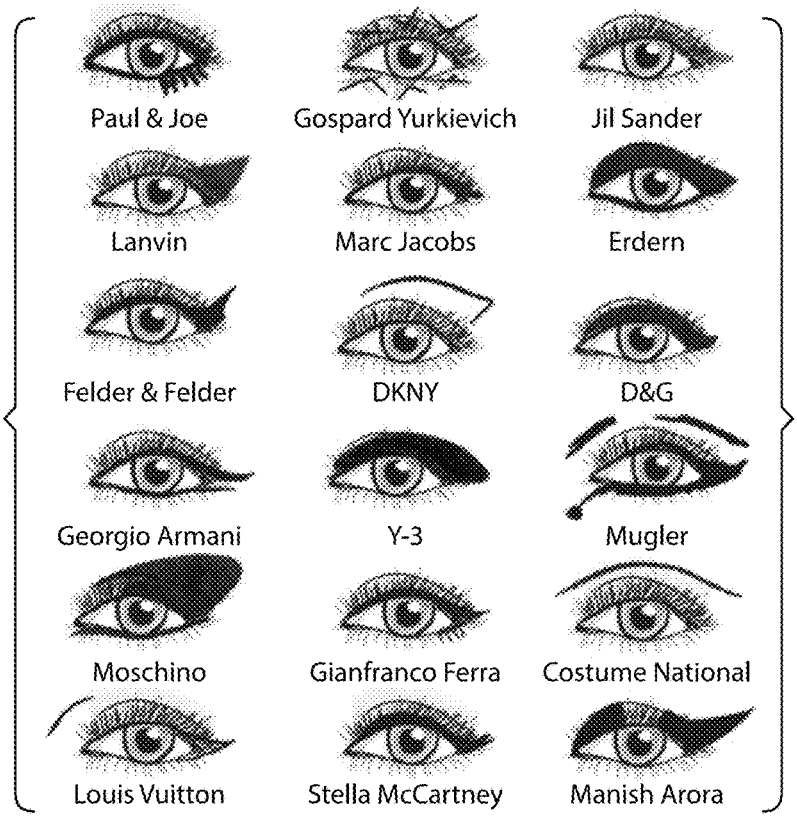
FIGS. 22 to 23 show examples of additional shapes for use with the cat eye applicator.
Figure 23:
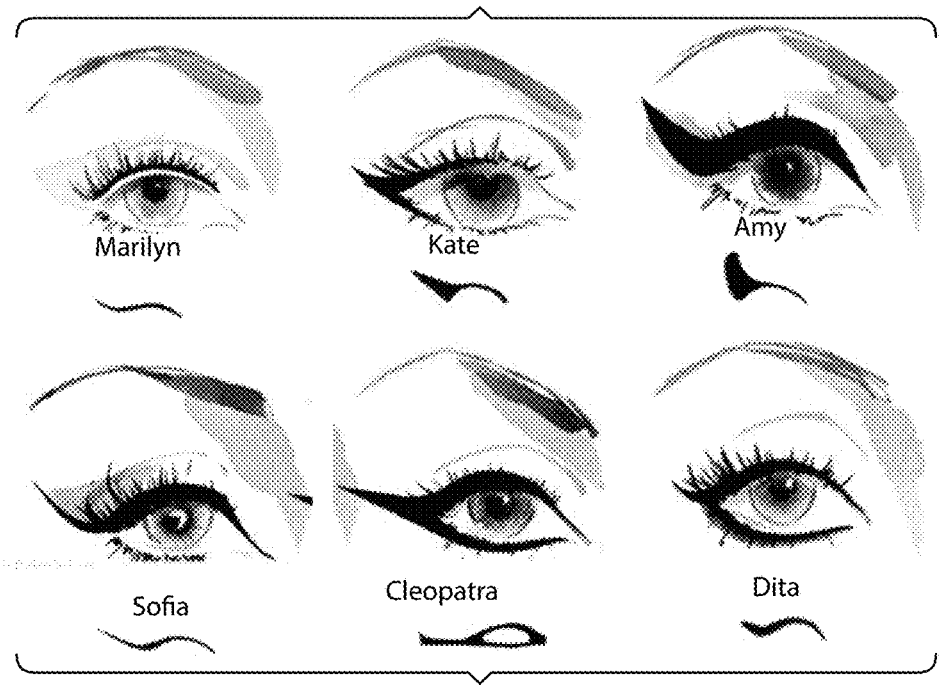

FIGS. 22 to 23 show examples of additional shapes for use with the cat eye makeup applicator 10. In the presently preferred embodiment, as discussed below, differently shaped cat eye stamping members 30 will be provided for detachable use with one or more handles 20.

Other Embodiments

In an alternative embodiment, the handle 20 is detachable so that the consumer can easily use a variety of cat eye shapes by interchanging the stamps 30 onto the handle. Any suitable method of attachment may be used, but the presently preferred methods involve a friction fit connection or a threaded connection.

Second Embodiment

Figure 24A:
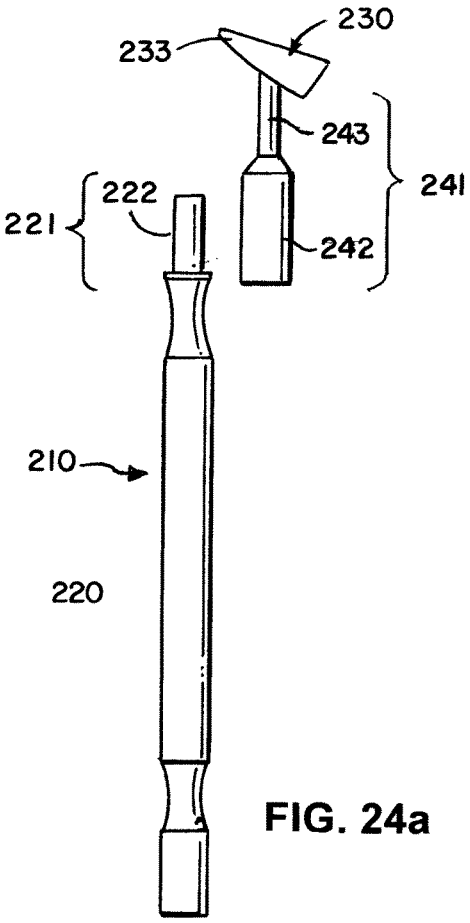
FIG. 24*a* shows a second preferred cat eye makeup applicator 210 comprised of a handle 220 having a distal end 221 with a support extension 222 and a detachable stamping member 230 having a base portion 241 with a sleeve 242 and a neck 243.
Figure 24B:
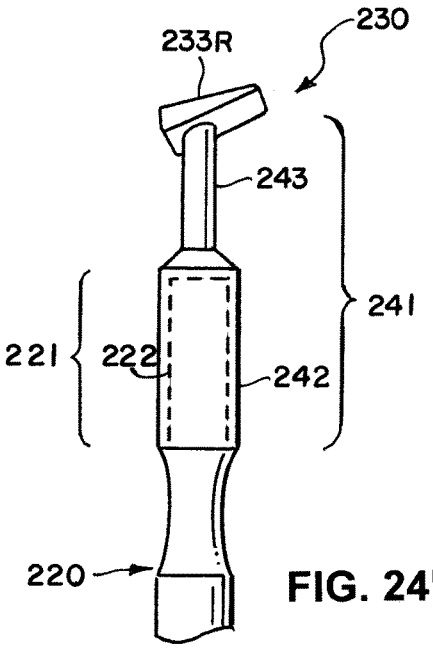
FIG. 24*b* shows the stamping member 230 affixed to the handle 220 with the handle's support extension 222 inside of the stamping member's sleeve 242.

FIGS. 24*a* and 24*b* illustrate a second preferred embodiment of a cat eye makeup applicator 210 comprised of a handle 210 and a cat eye stamping member 230. Here, however, the stamping member 230 is detachable from the handle 220. In more detail, the preferred handle 210 is formed of a rigid material (metal, plastic, etc.) and a distal end 221 of the handle 220 is provided with a support extension 222.

The cat eye stamping member 230, like the first embodiment, has left-side and right-side stamping surfaces 233L (opposite side) and 233R (shown). In this embodiment, however, the overall cat eye stamping member 230 is generally formed from a common material that is soft and elastic, preferably silicone rubber, so that the stamping surface compresses against the user's face to thoroughly transfer eyeliner to the user's skin from substantially the entire surface of the stamping surface. In other words, there is no need for separate stamp supports made of foam.

For detachable connection to the handle 220, the second preferred cat eye stamping member 230 comprises a tip portion (having the left and right-side stamping surfaces) and a base portion 241 comprised of a sleeve 242 and a neck 243. As best shown in FIG. 24*b*, the sleeve 242 is pressed onto the support extension 222 to attach the stamping member 230 to the handle 220.

In this embodiment, and others, the handle 220 extends at a right angle from the cat eye stamping member 30 so there is never a question at what angle the cat eye makeup applicator 210 needs to be oriented. Thus, all you have to do is hold the handle 220 straight up and down and then line up to the cat eye stamping member with the outer corner of the eye.

Third Embodiment

Figure 25A:
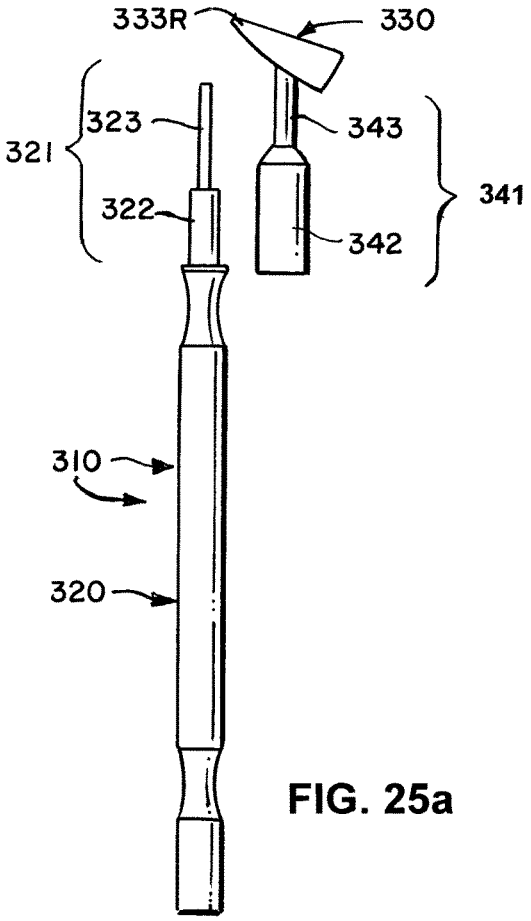
FIG. 25*a* shows a third, presently preferred cat eye makeup applicator 310 comprised of a handle 320 having a distal end 321 with a concentric pair of support extensions 322, 323 and a cat eye stamping member 330 having a base portion 341 with a sleeve 342 and a neck 343.
Figure 25B:
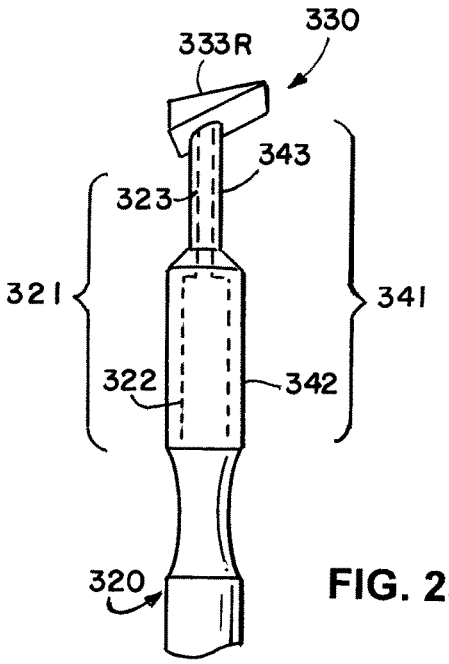
FIG. 25*b* shows the stamping member 330 affixed to the handle 320 with the handle's broader support extensions 322 inside of the stamp member's sleeve 342, and with the handle's narrower support extension 323 inside of the stamping member's neck 343 for added support.

FIGS. 25*a* and 25*b* illustrate a cat eye makeup applicator 310 according to a third preferred embodiment that is similar to the second, the difference being that the handle 320's distal tip 321 comprises not just one, but two concentric support extensions 322, 323.

For detachable connection to the handle 320, the third preferred cat eye stamping member 330 comprises a tip portion (having the left and right-side stamping surfaces) and a base portion 341 comprised of a sleeve 342 and a neck 343. As best shown in FIG. 25*b*, the sleeve 342 is pressed onto the handle 320 such that the support extensions 322, 323 extend into corresponding internal channels (not separately numbered) within the stamping member 330. The second support extension 323 is useful for supporting the relatively flexible neck 343 of a stamping member 330 formed of silicone

Fourth Embodiment

Figure 27:
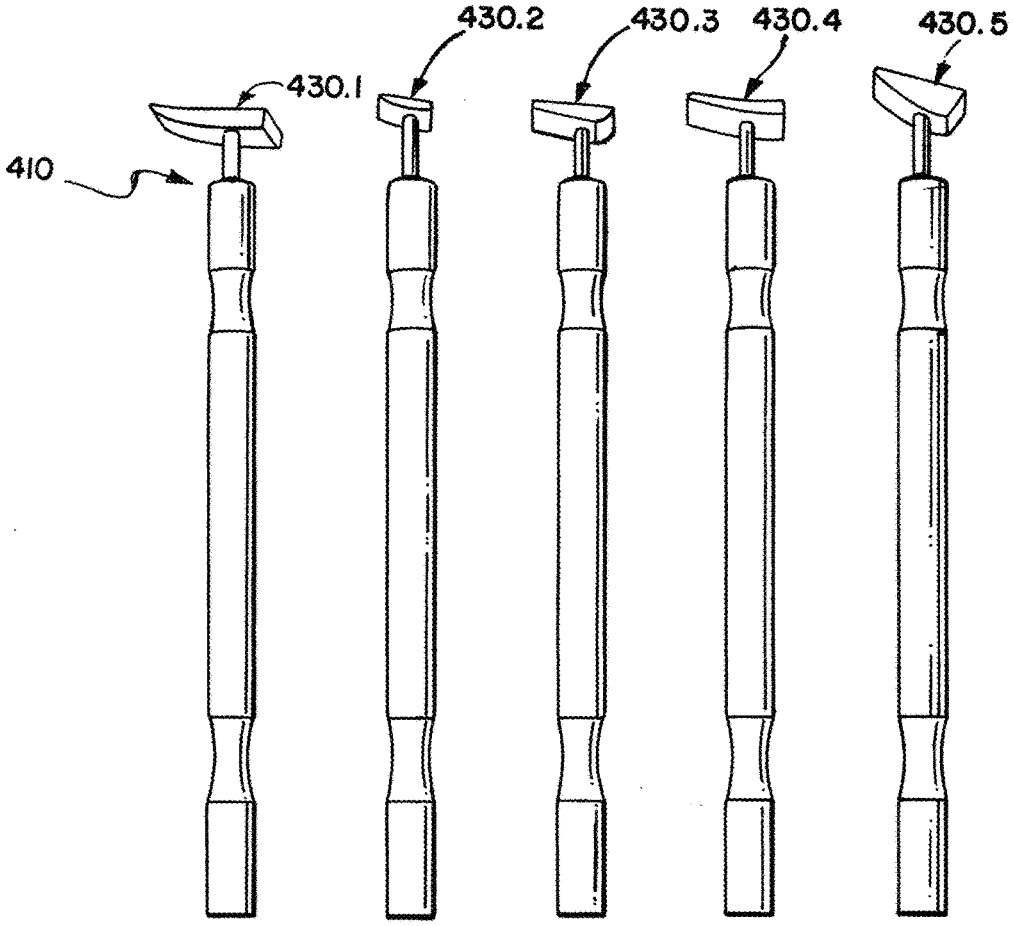
FIG. 27 shows a set of fourth preferred cat eye makeup applicators 310, each comprised of a handle 420 and a cat eye stamping member 430.1, 430.2, 430.3, 430.4, or 430.5 formed of rigid plastic (e.g. polyethylene) and having differently shaped cat eye stamps.

FIG. 27 shows a set of fourth preferred cat eye makeup applicators 310, each comprised of a handle 420 and a cat eye stamping member 430.1, 430.2, 430.3, 430.4, or 430.5 formed of rigid plastic (e.g. polyethylene, nylon, etc.), each cat eye stamping member having a differently shaped cat eye stamps. The set could comprise one handle for each stamping member, as shown, or one handle and a plurality of different stamping members that are connected to that one handle as needed.

The stamping members 430.1 etc. may be friction fit connected to the handle 420, with a suitable threaded arrangement, or through other means.

Figure 26:
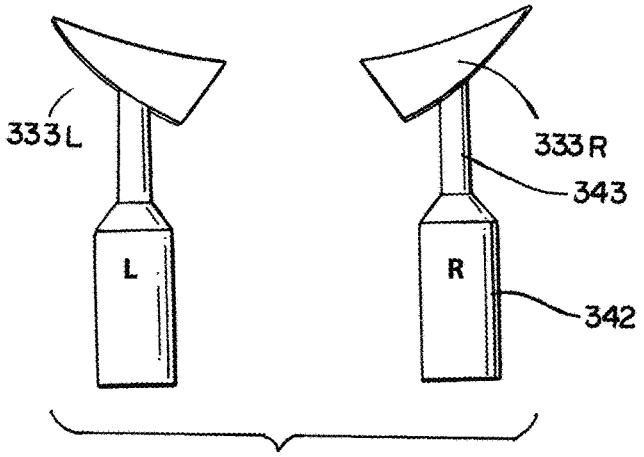
FIG. 26 shows the left and right side of the detachable cat eye stamping member 330, with molded-in indicia "L" and "R" indicating which side of the stamping member is facing the user.

Even other embodiments may feature suitable indicia to clearly indicate that the "left" or "right" side of the cat eye stamp 30 is facing the user. FIG. 26, for example, shows the left and right side of the detachable cat eye stamping member 330 with molded-in indicia "L" and "R" indicating which side of the stamping member is facing the user.

The invention claimed is:

1. A cat eye makeup applicator for applying eyeliner to a user's face in the form of left-side and right side cat eye extensions comprising:

a handle having a distal end and defining a longitudinal axis, the distal end of the handle comprising a first support extension and a second narrower support extension extending further therefrom;

a detachable stamping member with a cylindrical base portion supported by the distal end of the handle, a narrower intermediate neck portion extending distally from the cylindrical base portion and a tip portion forming a cat eye stamp at a distal end of the intermediate neck portion, wherein the cylindrical base portion and intermediate neck portion have an internal channel, and a friction fit connection is provided between the internal channel of the cylindrical base portion and an exterior of the first support extension of the handle, the second narrower support extension extending into the internal channel of the intermediate neck portion, the cat eye stamp having opposing left-side and right-side cat eye stamping surfaces for applying eyeliner to an outside corner of the user's left and right eyes, respectively, without applying eyeliner across central and inner corner portions of the user's eyelids, the left-side and right-side cat eye stamping surfaces are continuous surfaces, each having an asymmetric shape comprising a base area adapted to conform to an outside corner of the user's eye without extending across central and inner corner portions of the user's eyelids and a single tapering section extending laterally outwardly and upwardly from the base area when the base area is positioned on the outside corner of the user's eye, the tapering extension tapers from a larger width adjacent the base area to a terminal pointed end, and the left-side stamping surface and right-side stamping surface being mirror images of one another and wherein when either of the stamping surfaces is placed proximate the outer corner of the user's eye, the opposing stamping surface is visible at the same position and serves as a placement guide to properly position the stamp on the outer corner of the eye prior to making contact therewith.

2. The cat eye makeup applicator of claim 1 wherein the left-side and right-side cat eye stamping surfaces are provided on left-side and right-side cat eye stamp supports which are soft to allow the left-side and right-side cat eye stamping surfaces to compress slightly when pressed against the user's skin and thoroughly transfer eyeliner to the user's skin from substantially the entire surface of the left-side and right-side cat eye stamping surfaces.

3. The cat eye makeup applicator of claim 2 wherein the cylindrical base portion, the tip portion, the stamp supports, and the stamping surfaces comprise a common material.

4. The cat eye makeup applicator of claim 3 wherein the common material is a soft elastic material.

5. The cat eye makeup applicator of claim 4 wherein the soft elastic material is silicone rubber.

6. The cat eye makeup applicator of claim 3 wherein the common material is a rigid, self-supporting material.

7. The cat eye makeup applicator of claim 6 where the rigid, self-supporting material is polyethylene plastic.

8. The cat eye makeup applicator of claim 1 wherein the detachable stamping member bears indicia indicating whether the left-side or right-side stamping member is facing the user.

9. The cat eye makeup applicator of claim 8 wherein the indicia is molded into the cylindrical base portion of the detachable stamping member.

10. The cat eye makeup applicator of claim 9 wherein the indicia comprises the letters "L" and "R".

11. The cat eye makeup applicator of claim 1, wherein the pair of cat eye stamps comprises a left side stamp support supporting the left-side cat eye stamping surface where the left-side stamp support faces substantially transversely away from the longitudinal axis on one side of the tip portion and a right-side stamp support supporting the right-side cat eye stamping surface where the right-side stamp support faces substantially transversely away from the longitudinal axis on an opposite side of the tip portion, and wherein the left-side and right-side cat eye stamping surfaces extending generally transverse to the longitudinal axis of the handle such that when in use, the handle is adapted to extend longitudinally over the user's cheek while the tip portion is positioned over the corner of the user's eye to apply the asymmetrical shape thereto.

* * * * *